United States Patent [19]

Christian

[11] 4,112,558

[45] Sep. 12, 1978

[54] FABRIC BULKING PROCESS

[76] Inventor: Donald K. Christian, 119 Woodbine Ter., Spartanburg, S.C. 29301

[21] Appl. No.: 640,421

[22] Filed: Dec. 15, 1975

Related U.S. Application Data

[63] Continuation-in-part of Ser. No. 409,180, Oct. 24, 1973, Pat. No. 3,925,865.

[51] Int. Cl.[2] ..... D06C 1/00

[52] U.S. Cl. ..... 26/18.5; 34/10

[58] Field of Search ..... 26/18.5; 28/72 FT, 281; 68/5 D; 239/455; 34/10, 157

[56] References Cited

U.S. PATENT DOCUMENTS

| | | | |
|---|---|---|---|
| 1,627,250 | 5/1927 | Parker | 239/455 |
| 3,002,700 | 10/1961 | Mohring | 239/455 |
| 3,074,261 | 1/1963 | Wilcox | 68/5 D |
| 3,367,039 | 2/1968 | Jacobsen | 68/5 D X |
| 3,492,838 | 2/1970 | Reiners et al. | 68/5 D |
| 3,512,265 | 5/1970 | Fleissner | 34/10 |
| 3,594,914 | 7/1971 | Kutsuki et al. | 26/18.5 UX |
| 3,603,119 | 9/1971 | Kawaguchi | 68/5 D |
| 3,739,483 | 6/1973 | Meier-Windhorst | 34/157 X |
| 3,763,669 | 10/1973 | Bous et al. | 68/5 D |

FOREIGN PATENT DOCUMENTS

| | | | |
|---|---|---|---|
| 678,901 | 7/1939 | Fed. Rep. of Germany | 239/455 |

*Primary Examiner*—Robert R. Mackey

[57] ABSTRACT

The process of the present invention comprises feeding a fabric along a loop of predetermined length, controlling the length of the loop and impinging high velocity gas of a predetermined temperature and velocity against the fabric in the loop so as to treat the fabric with a heating medium of a predetermined temperature while simultaneously providing substantial mechanical action to the fabric, and thereafter removing the fabric from the treating zone.

6 Claims, 3 Drawing Figures

FABRIC BULKING PROCESS

This application is a continuation-in-part of application Ser. No. 409,180 filed Oct. 24, 1973, now U.S. Pat. No. 3,925,865 granted Dec. 16, 1975.

BACKGROUND OF THE INVENTION

Numerous techniques have heretofore been devised for treating textile fabrics, particularly knitted goods, so as to bulk the goods and thus increase the cover factor of same. Various and sundry techniques have been devised for bulking such fabrics, including the immersion of the fabrics in a heated liquid such as water, agitating the fabric in a heated liquid, agitating the liquid and the like.

The present invention is yet another improvement of a technique for bulking a textile fabric and has certain definite advantages over the prior art attendant thereto as will be discussed hereinafter. A heated gas, such as air, for example, is employed whereby the temperature of the air may exceed the boiling point of water, for example, without the necessity of a completely pressurized system.

SUMMARY OF THE INVENTION

It is the object of the present invention to provide an improved process for bulking textile fabric.

Another object of the present invention is to provide an improved process for bulking a knit fabric.

Another object of the present invention is to provide an improved process for the bulking of textile fabric utilizing a high velocity, heated gas as the bulking medium.

Generally speaking, the apparatus of the present invention comprises a vessel, said vessel having a fabric path therethrough; means to drive a fabric along said path, said drive means being provided at the entrance and exit path with no intermediate stationary support means located therealong; means to direct high velocity gas against said fabric along said path; means to control the length of a fabric loop along said path and means to remove fabric from said vessel, said fabric removal means being coordinated with said loop control means whereby tension on said fabric is controlled in said loop.

More specifically, an insulated vessel is preferably provided within which is located a pressurized gas manifold having a plurality of high velocity nozzles extending therealong. One preferred embodiment of the invention provides a high velocity nozzle at the entrance and exit of the fabric loop extending across the width of the fabric path. Driven rolls are provided at the entrance and exit of the vessel so as to control fabric feed into the vessel and also the fabric exit from the vessel. Moreover, a loop control means is provided to continuously control the length of the fabric loop in the vessel, the loop control being operatively associated with the exit drive roll so as to continuously maintain a proper length loop. Pressurized air or other gas at an elevated temperature is impinged upon the fabric, substantially perpendicular thereat. The heated gas thus heats the fabric to a predetermined temperature, while at the same time affording a substantial mechanical working action of the fabric. The fabric is bulked thereby.

The apparatus of the present invention may be provided with a variable nozzle whereby different air flow patterns may be impinged upon fabric passing thereby. The nozzles extend along substantially the entire width of the fabric and are presented in one or more locations around the fabric loop. Baffles are provided internally of the gas manifold to afford a proper diffusion of the gas at the nozzle entrance. The gas thereby extends directly from the nozzle and impinges against the fabric according to the desired angle and pattern.

Generally speaking, the process of the present invention comprises the steps of feeding a fabric along a fabric path and providing a fabric loop thereat; controlling the length of the fabric loop so as to control tension on the fabric; and substantially impinging a heated gas against said fabric so as to produce a substantial mechanical action on the fabric without providing any substantial lateral movement of the fabric away from the gas stream. Specifically, air or some other gas is heated to a predetermined temperature which can exceed that of the boiling point of water and is provided under pressure in a manifold having a plurality of nozzles extending therefrom and directed in the direction of the path of travel of the fabric along at least one portion of the loop. Preferably, the nozzle is positioned so as to provide an upward force against the fabric around a driven roll at the entrance to the vessel so as to insure a good mechanical action on the fabric.

DESCRIPTION OF THE PREFERRED EMBODIMENTS

Figure 1:
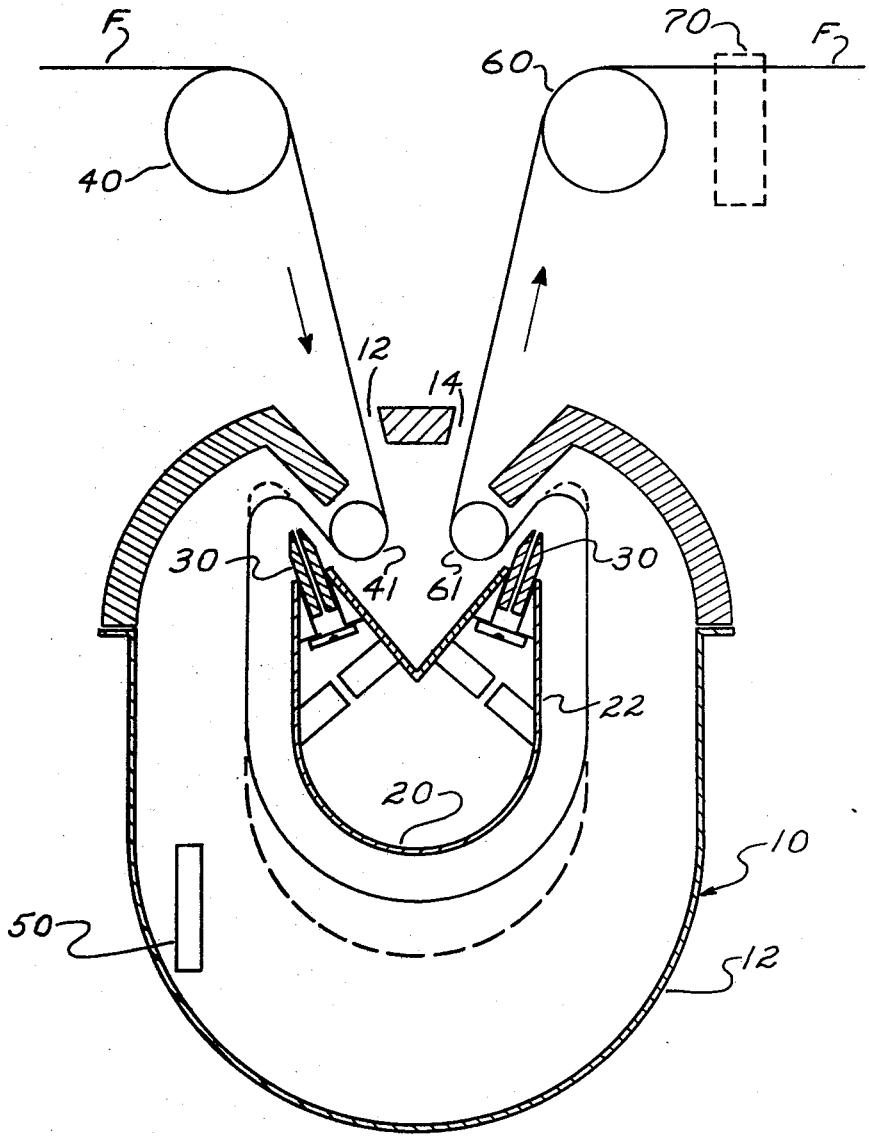
FIG. 1 is a side elevational schematic of a bulking unit according to the teachings of the present invention.

Making reference to the Figures, a specific embodiment of the present invention will now be described in detail. Referring to FIG. 1, a bulking vessel generally indicated as 10 is shown. Vessel 10 is composed of side walls 12 that are preferably stainless steel and thermally insulated to conserve heat in the bulking area. Positioned within vessel 10 and along the length thereof so as to permit treatment of the entire width of a fabric passing therethrough is a gas pressure manifold generally indicated as 20. Gas pressure vessel 20 is, in effect, a manifold that extends across the width of the treatment area and has at least one and preferably a plurality of high velocity gaseous nozzles 30 extending through the side walls 22 in communication with the interior thereof. Each nozzle is positioned at a particular angle so as to direct gas at high velocity against fabric F according to the predetermined angle and thus impart a substantial mechanical action thereon. As shown in FIG. 1, the fabric F is fed into vessel 10 by a pair of driven rolls 40 and 41 that are operating at predetermined speeds. Immediately inside vessel 10, making entrance through passageway 12, fabric F encounters the second roll 41 and passes partially therearound. Air which has been heated to a particular predetermined temperature by a heating means (not shown) exits nozzle 30 at high velocity from pressure manifold 20 impinging on fabric F and causing said fabric to be distended upwardly away from its normal path. In the illustration of FIG. 1, the short dotted lines located above nozzles 30 indicate an approximate path of fabric F while distended upwardly by high velocity gas exiting from nozzles 30. The fabric, in effect, is supported by the jet of high velocity gas without other mechanical supporting means as it passes in transit through the apparatus from feeding means to withdrawal means. In FIG. 1, the long dotted lines located below pressure manifold 20 indicate an alternate path of fabric F that could be selected by adjustment of loop control 50. Heat from the heated air raises the temperature of the fabric to substantially the same temperature as said air, while at the same time the mechanical action caused by undulations and/or rolling action of the fabric in transit through the apparatus facilitates bulking. Positioned within vessel 10 is a loop control device 50. Loop control device 50 may be any conventional loop control system that primarily senses the length of the fabric loop within vessel 10 and is operatively associated through conventional means with driven rollers 60 and/or 61 so as to control the length of the loop in vessel 10 and thus further control the degree of bulking to which the fabric will be subjected. For example, the above loop control device could be one of the type described in Christian et al., U.S. Pat. No. 3,721,376.

The bulking unit of the present invention may be employed in conjunction with other process equipment such as, for example, a tenter frame, a washer or the like. In this regard, since the air or other gas within the pressure chamber 20 is heated so as to accomplish bulking of the fabric, the fabric will exit the vessel 10 at an elevated temperature. As such, it may be desirable to provide a cooling zone 70 subsequent to exit passageway 14 of vessel 10. Cooling zone 70 may be a purely ambient zone, a zone wherein artificial cooling is employed so as to more rapidly reduce the temperature of the fabric, or the like.

Figure 2:
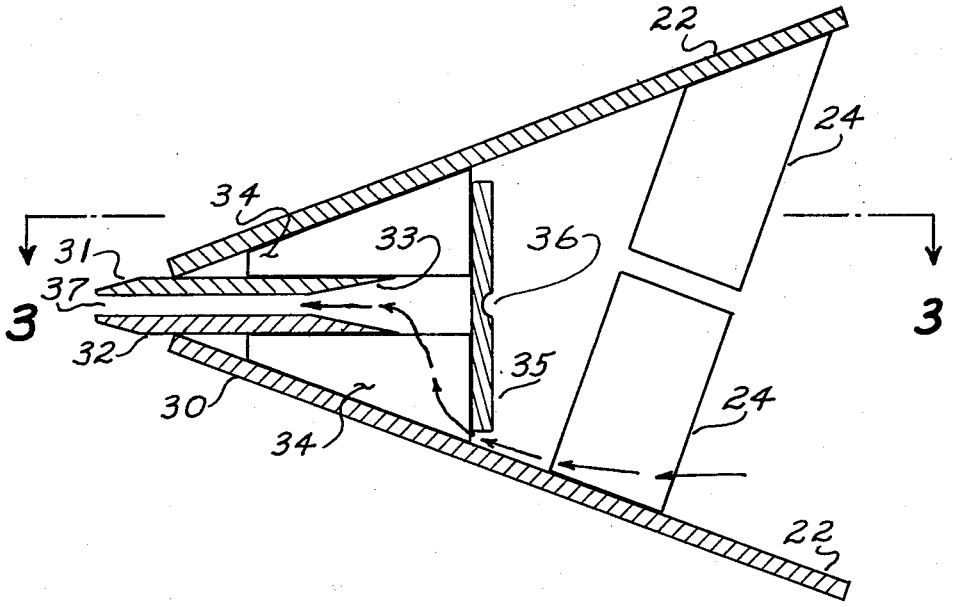
FIG. 2 is a side cross sectional view of a nozzle arrangement according to the teachings of the present invention.
Figure 3:
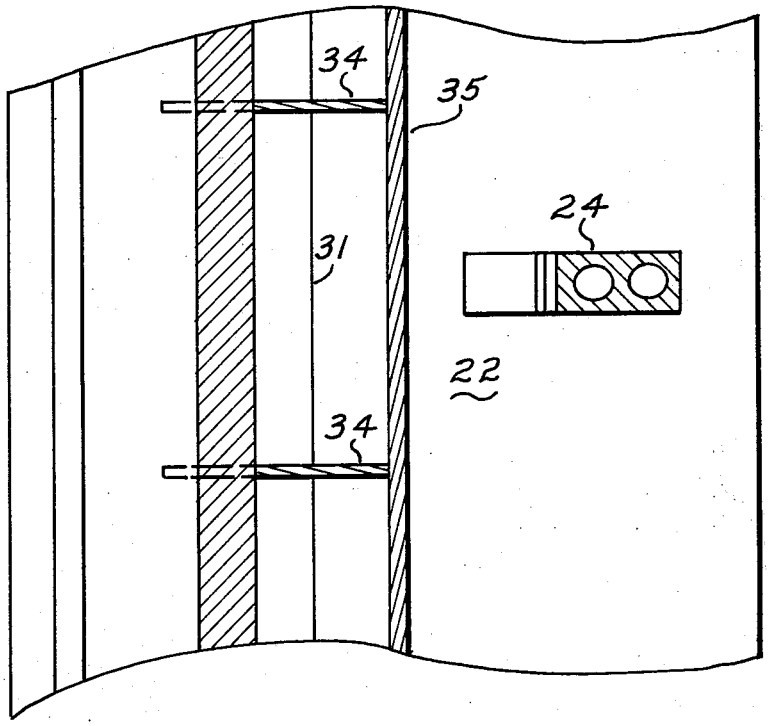
FIG. 3 is a cross sectional view of a nozzle arrangement taken along a line 3—3 in FIG. 2.

It may be desirable to vary the geometry of the nozzles through which the gas passes for impingement onto fabric F. In this regard, reference is made to FIGS. 2 and 3. The nozzle generally indicated as 30 is shown received between side walls 22 of pressure vessel 20. The nozzle passageway or throat 37 is provided by a pair of elements 31 and 32 which may have bevels 33 at the rear ends thereof. It may be desirable as shown in FIG. 2 to dispose members 31 and 32 in parallel relationship so as to provide a straight walled nozzle slot across the width of the bulking zone. Secured on opposite sides of members 31 and 32 are struts 34 which are spaced apart along the width of the nozzle 30 (See FIG. 3) and extend rearwardly beyond the ends of members 31 and 32. Struts 34 are unified by a baffle 35 which extends across the entire width of nozzle 30 and serves as a baffle for diffusion of gas being dispensed therefrom. Note that baffle 35 has a cutaway portion 36 along a central location thereof. Wall members 22 adjacent nozzle 30 are provided with an adjustment member 24. Member 24 is hand actuated by means of jacking and/or clamping screws. Movement of adjustment member 24 inwardly or outwardly will cause a slight deflection of members 31 and 32 that define nozzle throat 37 whereby a predetermined relationship may be established in the nozzle 30 so as to further delineate the type flow pattern of the gas exiting therefrom.

Gas flow from within vessel 20 will not flow directly into the throat 37 of nozzle 30. Instead, baffle 35 is encountered and the air or other gas flows around baffle 35 between struts 34 as shown by the arrows in FIG. 2. In this fashion, the angle of air exiting from nozzle 30 is better controlled.

Insofar as gas impingement on the fabric is concerned, it should be pointed out that angular impingement of the gas on the fabric is undesirable to the point that the fabric may be moved away from the treating zone in a direction to the right or left of the longitudinal axis of the nozzle 30. Obviously, the force of the gas exiting the nozzle 30 will force the fabric directly away from the slot, but a lateral or sidewise motion is the undesirable feature being referred to. It is thus preferred that the net force of air being expelled from nozzle 30 should be approximately perpendicular to the surface of the fabric. In this regard, the net force may be a vector force, since it may be desirable to modify certain areas of the slots to provide a predetermined mechanical motion to achieve an improved bulking action while at the same time maintaining the fabric in proper position with respect to nozzle 30.

Generally speaking, the process of the present invention proceeds as follows. A fabric F is fed by driven roll 40 into treating vessel 10 where it is engaged by a driven roll 41 and passes partially therearound. Immediately after roll 41, fabric F experiences an impingement of gas from a nozzle 30 that forces the fabric upwardly away from the nozzle 30. Preferably, the impingement of gas is perpendicular to the surface of the fabric and is of sufficient magnitude to impart a substantial mechanical action to the fabric. This mechanical action is in either an undulating fashion caused by the speed of travel of the fabric compared with the velocity of the treating fluid or a rolling action created by the fabric advancing to the apex of the treating fluid flow path and then by its own weight progressing downward into the treatment vessel. This action is very effective in releasing the plastic memory or crimp memory of the synthetic fibers such as, but not limited to, polyester and nylon. Furthermore, the temperature of the gas being handled by nozzle 30 is such that bulking is imparted to the fabric. Furthermore, the fabric passes under the bottom of a manifold 20 from whence the pressurized gas is expelled and forms a loop therearound. A loop control device 50 senses the length of the loop and controls the rotational speed of drive roll 61 and/or drive roll 60 so as to remove fabric from vessel 10 through exit 14 at a speed required to provide the loop of the desired length. As shown in FIG. 1, a further nozzle 30 is provided adjacent drive roll 61 and exit 14 so as to further treat fabric F. Once fabric F passes out exit 14 and around drive roll 60, it may then pass through an optional cooling zone 70 and to further processing.

The gas utilized to bulk fabric according to the present invention may be maintained at such temperature as desired for the particular fabric being treated. Further, the gas may be handled at a particular pressure to achieve desired mechanical agitation of the fabric. There is no general limit to the particular gas suitable for use according to the present teachings, though air is generally preferred. Other ingredients such as cleaning solvents, fabric softener or the like may be entrained in the gas according to the dictates of the process.

Having described the present invention in detail, it is obvious that one skilled in the art will be able to make variations and modifications thereto without departing from the scope of the invention. Accordingly, the scope of the present invention should be determined only by the claims appended hereto.

What I claim is:

1. A method for bulking a textile fabric comprising feeding the fabric under a restraining means into a treating vessel having two upwardly oriented nozzles therein at predetermined angles, withdrawing the fabric passing in transit under said restraining means, over an upwardly oriented nozzle, under a pressure manifold system which supplies the nozzles, over another upwardly oriented nozzle and under another restraining means thus forming a downwardly extending loop within the vessel, said loop generally encircling the pressure manifold system, the said loop being suspended from and formed solely by an upwardly directed gaseous flow from said nozzles, the fabric being bulked by actions induced therein by said air streams within the treating vessel.

2. The process as defined in claim 1 wherein the gaseous flow is heated.

3. The process as defined in claim 1 wherein said gaseous flow is air.

4. The process as defined in claim 1 wherein some other ingredient is introduced into the gaseous flow.

5. The process as defined in claim 1 wherein the fabric is positively cooled after bulking.

6. The process as defined in claim 1 including sensing the extent of the loop for controlling the rate of travel of the fabric through the vessel.

* * * * *